US005662219A

United States Patent [19]

Tschudy et al.

[11] Patent Number: 5,662,219

[45] Date of Patent: Sep. 2, 1997

[54] APPARATUS FOR CARRYING A CONCEALED WEAPON AND METHOD

[76] Inventors: Daniel W. Tschudy, 3821 N. Apache Way, Scottsdale, Ariz. 85251; Roger L. Otterstein, 13556 N. 103 Way, Scottsdale, Ariz. 85260; Kenneth M. Grise, 8507 E. Mallory, Mesa, Ariz. 85207

[21] Appl. No.: 520,306

[22] Filed: Aug. 28, 1995

[51] Int. Cl.[6] ..... B65D 85/00; E05B 65/52; A45C 3/00; A45C 13/02

[52] U.S. Cl. ..... 206/317; 70/63; 150/113; 150/114; 190/102

[58] Field of Search ..... 206/214, 317, 206/232; 150/112, 117, 119, 123, 113, 114; 190/111, 903, 102; 224/911, 914; 42/1.09; 70/63

[56] References Cited

U.S. PATENT DOCUMENTS

| | | | |
|---|---|---|---|
| 2,115,993 | 5/1938 | Kranhold | 190/903 X |
| 2,556,066 | 6/1951 | Cline | 190/111 |
| 2,845,105 | 7/1958 | Neas | 150/117 |
| 3,352,391 | 11/1967 | Vaughan | 190/111 |
| 4,466,537 | 8/1984 | McMahan | 206/317 |
| 4,925,021 | 5/1990 | Pulichino, Jr. | 190/903 X |
| 5,036,973 | 8/1991 | Aida | 206/214 |
| 5,056,342 | 10/1991 | Prinz | 70/63 |
| 5,172,575 | 12/1992 | Fisher | 70/63 |
| 5,299,722 | 4/1994 | Cheney | 206/317 X |
| 5,495,967 | 3/1996 | Parton | 224/911 X |

*Primary Examiner*—Bryon P. Gehman

*Attorney, Agent, or Firm*—Harry M. Weiss; Jeffrey D. Moy; Harry M. Weiss & Associates, P.C.

[57] ABSTRACT

The apparatus for carrying a concealed weapon provides inconspicuous means for carrying a weapon into any social or business setting. It consists of an outer gun case shaped to resemble an organizer. Concealed inside by means of a fastening device is a support structure for securing the weapon. The support structure consists of a removable holder block which has a cavity shaped to contour the outline of the weapon it is intended to hold. The support structure may also have further cavities for holding ammunition for the weapon. The support structure also has easy access portions in proximity to its edge to facilitate the easy removal of the weapon from the support structure. The concealed gun case could also be designed to have an additional chamber that may be independently accessed without revealing the presence of the weapon in the gun chamber. This additional chamber could contain a daily planner and other stationery material.

23 Claims, 6 Drawing Sheets

APPARATUS FOR CARRYING A CONCEALED WEAPON AND METHOD

BACKGROUND OF THE INVENTION

1. Field of the Invention

This invention relates generally to cases for carrying a weapon and, more specifically, to apparatus for covertly carrying a weapon and methods therefor.

2. Description of the Prior Art

With violent crimes on the rise, increasing numbers of citizens are acquiring guns for self defense. Yet, openly displaying a weapon is not acceptable in most social and business settings. Nonetheless, in recent years, a number of states have made it lawful to carry a concealed weapon in public, and many more state legislatures are considering adopting similar statutes. Unfortunately, the market has not yet responded creatively to enable a person to covertly carry a weapon in public.

A person desiring to carry a concealed weapon was previously limited to three main options—a shoulder holster, a fanny pack, or the inside of the sock or boot. None of these have proven satisfactory. To be able to use a shoulder holster for concealing a weapon, one must wear a jacket over it. Even with a jacket over the holster, there is typically a telltale bulge revealing the presence of the holster. A fanny pack is not acceptable in most formal settings. Finally, hiding the gun in a sock or a boot is both cumbersome and awkward. Further, in an emergency situation, it is not possible to remove the gun quickly from the boot or sock.

Therefore, there existed a need to provide a convenient and inconspicuous apparatus for use by both men and women to conceal a weapon in a manner acceptable in any business or social situation.

SUMMARY OF THE INVENTION

In accordance with one embodiment of this invention, it is an object of this invention to provide an apparatus for carrying a concealed weapon.

It is another object of this invention to provide an apparatus that is handy, inconspicuous and acceptable in any business or social situation.

It is yet another object of this invention to provide an apparatus that, when closed, resembles a personal organizer and can unobtrusively conceal a weapon inside.

It is a further object of this invention to provide an apparatus that has two separate and independently accessible compartments, one for concealing a weapon, and the other for holding a daily planner and/or other stationery material.

It is a still further object of this invention to provide an apparatus which has special features that enable the weapon to be extracted quickly.

BRIEF DESCRIPTION OF THE PREFERRED EMBODIMENTS

In accordance with one embodiment of this invention, an apparatus for concealing and carrying a weapon is disclosed comprising, in combination, support means for supporting the weapon, covering means for enclosing the support means and concealing the weapon, and fastening means coupled to the covering means for closing the covering means to conceal the weapon and for opening the covering means to remove the weapon from the support means. The covering means has an exterior configuration having a substantially parallelepiped shape when closed and having an interior cavity. A first interior surface of the covering means has a plurality of pockets. The apparatus further includes first connection means, coupled to a second interior surface of the covering means located opposite the first interior surface when the covering means is closed, for removably attaching the support means to the covering means. The support means comprises a holder block having a first recess in a first side of the holder block for securing the weapon, and second connection means coupled to a surface of the holder block located opposite the first side of the holder block for removably coupling the support means to the covering means with the first and second connection means. The holder block forms the first recess by providing a bottom planar surface for supporting a bottom side of the weapon, and a perimeter wall surface extending upward from the bottom planar surface and around a portion of a perimeter area of the weapon when the bottom side of the weapon lies on the bottom planar surface. Note that the perimeter wall surface extends around all of the perimeter area of the weapon except for an area adjacent to a grip of the weapon. Additionally, the apparatus includes quick access means located beneath the bottom planar surface and comprising a depression in the bottom planar surface for permitting a user's fingers (the thumb is first inserted) to reach beneath the bottom planar surface for quickly removing the weapon. The apparatus also includes a recess in the first side of the holder block for retaining a magazine for use with the weapon, and including a still further recess in the first side of the holder block for retaining a speed loader for use with the weapon.

In accordance with another embodiment of this invention, an apparatus for carrying and concealing a weapon is disclosed comprising, in combination, support means for supporting the weapon, covering means for enclosing the support means and concealing the weapon, and divider means coupled to an inner lengthwise seam of the covering means for dividing an interior cavity of the covering means into a first and second sub-cavity. The apparatus further includes first fastening means coupled to the divider means and to the covering means for selectively opening and closing a portion of the covering means for selectively accessing the first sub-cavity containing the weapon and second fastening means coupled to the divider means and to the covering means for selectively opening and closing another portion of the covering means for selectively accessing the second sub-cavity. A first side of the divider means has a first plurality of pockets, and a first interior surface of the covering means has a second plurality of pockets. The first sub-cavity is enclosed by the portion of the covering means, the first side of the divider means, and the first fastening means, and the second sub-cavity is enclosed by the other portion of the covering means, a second side of the divider means, and the second fastening means. The apparatus further includes insert means coupled on a back side thereof with an inner portion of the covering means for retaining a pad of paper, a daily planner, or the like. This embodiment of the apparatus also includes first connection means, coupled to a second interior surface of the covering means located opposite the first interior surface of the covering means when the covering means is closed, for removably attaching the support means to the covering means. The support means comprises a holder block having a first recess in a first side of the holder block for securing the weapon, the first recess providing a bottom planar surface for supporting a bottom side of the weapon, and a perimeter wall surface extending upward from the bottom planar surface and around a portion of a perimeter area of the weapon when the bottom side of the weapon lies on the bottom planar surface, and second connection means coupled to a surface of the holder block located opposite the first side of the holder block for removably coupling the support means to the covering means with the first and second connection means. The perimeter wall surface extends around all of the perimeter area of the weapon except for an area adjacent to a grip of the weapon. This embodiment of the apparatus further includes quick access means located beneath the bottom planar surface and comprising a depression in the bottom planar surface for permitting a user's fingers (the thumb is first inserted) to reach beneath the bottom planar surface for quickly removing the weapon. The apparatus also includes a further recess in the first side of the holder block for retaining a magazine for use with the weapon, and including a still further recess in the first side of the holder block for retaining a speed loader for use with the weapon.

In accordance with another embodiment of this invention, a method for concealing and carrying a weapon is disclosed comprising the steps of providing support means for supporting the weapon, providing covering means for enclosing the support means and concealing the weapon, and providing fastening means coupled to the covering means for closing the covering means to conceal the weapon and for opening the covering means to remove the weapon from the support means. The step of providing the support means comprising the steps of providing a holder block having a recess in a first side of the holder block for securing the weapon, providing connection means coupled to a surface of the holder block located opposite the first side of the holder block for removably coupling the support means to the covering means. The step of providing the recess in the holder block comprises the steps of providing a bottom planar surface for supporting a bottom side of the weapon and a perimeter wall surface extending upward from the bottom planar surface and around a portion of a perimeter area of the weapon when the bottom side of the weapon lies on the bottom planar surface, and providing quick access means located beneath the bottom planar surface and comprising a depression in the bottom planar surface for permitting a user's fingers (the thumb is first inserted) to reach beneath the bottom planar surface for quickly removing the weapon.

The foregoing and other objects, features, and advantages of the invention will be apparent from the following, more particular, description of the preferred embodiments of the invention, as illustrated in the accompanying drawings.

BRIEF DESCRIPTION OF THE DRAWINGS

FIG. 6 is a perspective view of another embodiment of the apparatus showing an organizer chamber having a three-ring binder for holding papers, a daily planner, or the like.

DESCRIPTION OF THE PREFERRED EMBODIMENTS

Figure 1:
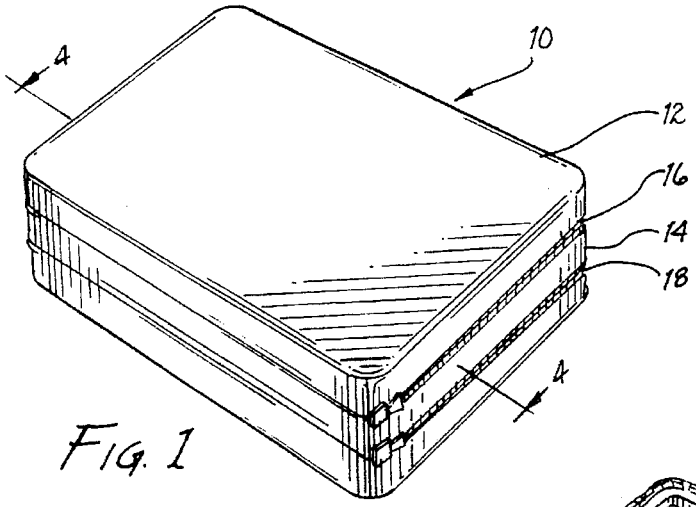
FIG. 1 is a perspective view of a gun case according to the present invention, enclosing two separate chambers inside.

FIG. 1 depicts a gun case 10 for containing and concealing a weapon (not shown). The gun case 10, in this embodiment, is shaped to look like an organizer, and thus be inconspicuous in any social or business setting. The gun case 10 has an outer covering 12 which encloses two separate compartments—the gun chamber 20 (see FIG. 2) and the organizer chamber 22 (see FIG. 3). The two chambers are separated by a divider 14.

Zippers 16 and 18 are attached to the covering 12 and to the divider 14. The zipper 16 seals the gun chamber 20 and the zipper 18 seals the organizer chamber 22. In the preferred embodiment, zippers 16 and 18 are used as the fastening devices, but other forms of fasteners could also be used. In this embodiment, since the gun case 10 has been shaped to resemble an organizer, it has two broad sides, 11 and 13 (see FIG. 4), and four narrow sides. The divider 14 is coupled to the narrow sides, and parallels the broad sides 11 and 13.

Figure 2:
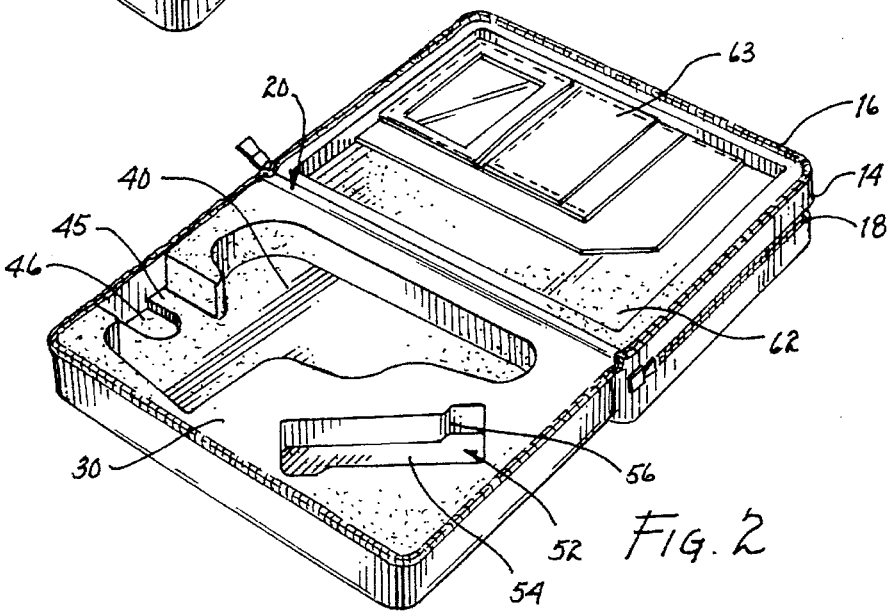
FIG. 2 is a perspective view of the apparatus opened to expose the gun chamber.
Figure 4:
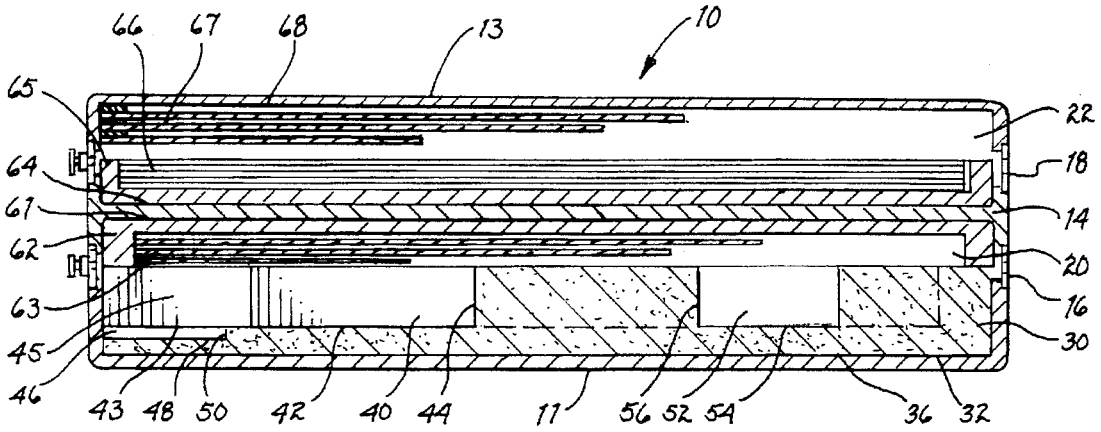
FIG. 4 is a cross-sectional view of the gun case taken through the line 4—4 in FIG. 1.
Figure 5:
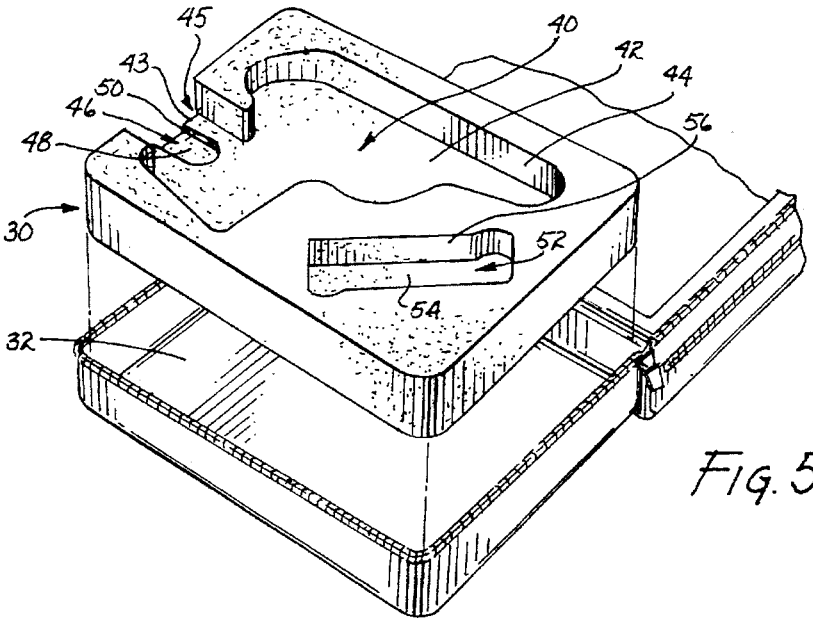
FIG. 5 is an exploded view of the gun chamber of FIG. 2.

FIGS. 2, 4 and 5 depict one embodiment of the interior of the gun chamber 20 according to the present invention. The gun chamber 20 is bounded on one side by a surface 61 of the divider 14 and on the opposite by the inside surface 32 of the broad side 11 of the gun case 10. A liner 62 is coupled to the surface 61. A number of pockets 63 are connected to the liner 62. These pockets 63 may be used to carry business cards, credit cards or stationery items.

Holder block=30 secures a weapon (not shown) in the gun cavity 40. The particular embodiment of the holder block 30 indicated in FIGS. 2 and 5 is for securing a semi-automatic pistol, but, as discussed later, the holder block 30 could be designed for other weapons too. The underside 36 of holder block 30 is removably attached to the inside surface 32 of the gun case 10 by coupling means such as VELCRO. For the sake of simplicity, this coupling means has not been shown in the drawings.

The gun cavity 40 is shaped to snugly fit around the weapon. The perimeter wall 44 of the gun cavity 40 contours the outline of the weapon. The gun cavity 40 is of substantially the same depth as the thickness of the weapon it is intended to contain. The bottom surface 42 of the gun cavity 40 on which the weapon rests is substantially planar.

Two notable features on the holder block 30 allow the weapon to be removed quickly from the gun cavity 40 in case of an emergency. The first is the grip access 45, provided by removing a portion of the holder block 30 adjacent to where the handle of the weapon would fit in the gun cavity 40. The bottom surface 43 of the grip access 45 is substantially planar with the bottom surface 42 of the gun cavity 40. Thus, the grip access 45 allows the user to remove the weapon from the gun cavity 40 by gripping the handle of the weapon.

To further facilitate the easy gripping of the handle of the weapon, a quick access 46 is provided by removing a portion of the bottom surfaces 42 and 43. The bottom surface 48 of the quick access 46 is substantially planar. The quick access 46 begins at the edge of the holder block 30, within the grip access 45, and extends into the gun cavity 40, with the perimeter wall 50 of the quick access 46 forming a "U". The width and depth of the quick access 46 are such as to permit a person's fingers to wrap around the handle of the weapon. Now, when the users wish to remove the weapon from the gun cavity 40, the users can easily insert their fingers (the thumb is first inserted) into the quick access 46. Thus, they can reach under the handle of the weapon and get a firm grip on the handle.

The holder block 30 also has provision for holding standard accessories that go with the weapon. In FIGS. 2, 4, and 5, the holder block 30 has an ammunition space 52 for securing a magazine clip (not shown) for use with the semi-automatic gun that would be held in gun cavity 40. The perimeter wall 56 of the ammunition space 52 contours the outline of the magazine clip. The bottom surface 54 of the ammunition space 52 is substantially planar, and sunk to a depth approximately equal to the thickness of the magazine clip.

FIGS. 13–18 are different views of the same embodiment of the holder block 30 depicted in FIGS. 2, 4, and 5.

Figure 21:
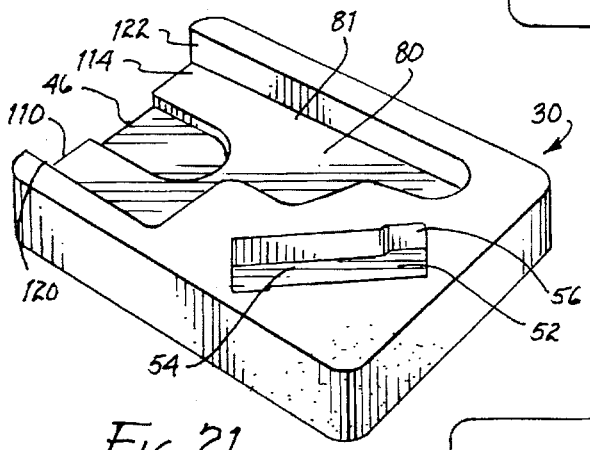
FIG. 21 is a perspective view of another embodiment of the holder block for holding a gun and magazine.
Figure 22:
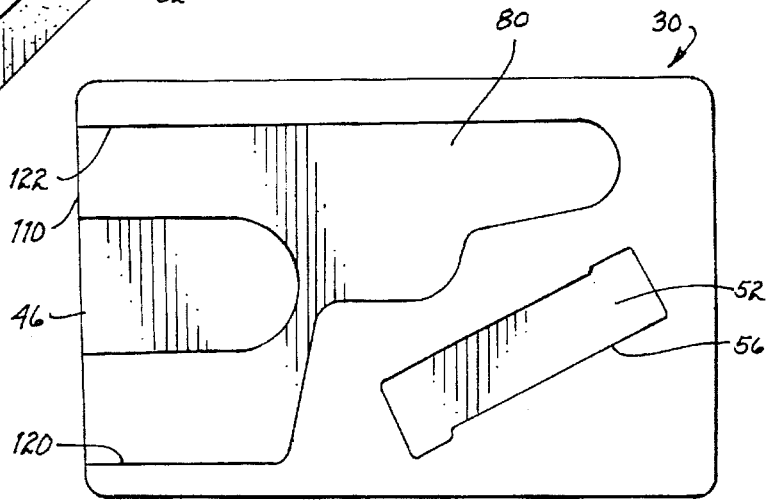
FIG. 22 is a top view of the holder block in FIG. 21.

FIGS. 21 and 22 show the holder block 30 with different embodiments of the gun cavity 80 and grip access 110. This holder block, too, is intended to secure a semi-automatic gun. The major modification here is the widened grip access 110. This is achieved by removing sections 112 and 118 (see FIG. 13) of the holder block 30 adjacent to the sides 49 and 47, (see FIGS. 13–18) respectively, of the previously discussed grip access 45. The bottom surface 114 (FIG. 21) of the widened grip access 110 is maintained substantially planar with the bottom surface 81 of the modified gun cavity 80. The spacing between sides 120 and 122 of the widened grip access 110 is such as to allow the weapon to be slipped out from the modified gun cavity 80 through the grip access 110. Without the widened grip access 110, the grip access 45 (see FIGS. 13–18) would not allow the weapon to be slipped out through it, and the weapon would have to be vertically lifted out of the gun cavity 40. Thus, the new grip access 110 allows the weapon to be removed horizontally and easily, which can be critical in an emergency situation.

FIGS. 7–12 show another embodiment of the present invention—a holder block 30 designed to secure a revolver (not shown) and its ammunition (not shown). The perimeter wall 78 of the gun cavity 41 contours the outline of a revolver. The bottom surface 39 of the gun cavity 41 is substantially planar. The grip access 70 and the quick access 146 are similar, in structure and purpose, to the grip access 45 and quick access 46 in FIGS. 2, 4 and 5. The bottom surface 71 of the grip access 70 is substantially coplanar with the bottom surface 39 of the gun cavity 41. The bottom surface 148 Of the quick access 146 is also substantially planar but sunk below the bottom surface 71 of the grip access 70 and the bottom surface 39 of the gun cavity 41. As explained before, the quick access 146 and the grip access 70 together allow the user to reach around and beneath the handle of the weapon secured in the gun cavity 41, thereby permitting quick removal of the weapon.

The ammunition spaces 72 and 73 are for holding speed loaders (not shown). The bottom surfaces 74 and 75 of the two ammunition spaces 72 and 73 are substantially planar and the perimeter walls 76 and 77 contour the outline of a speed loader. The depth of the ammunition spaces 72 and 73 is substantially equal to the thickness of a speed loader.

Figure 19:
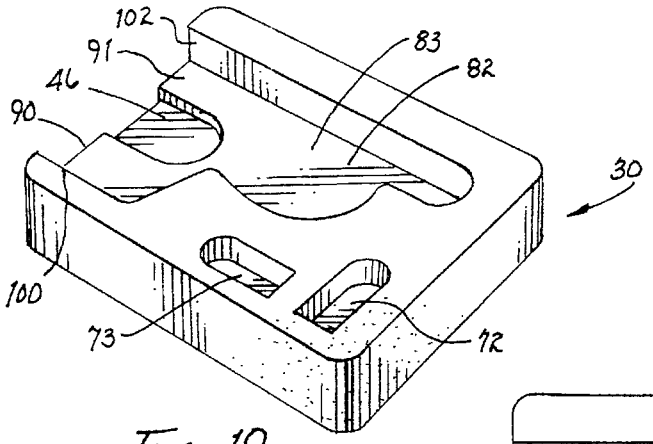
FIG. 19 is a perspective View of another embodiment of the holder block for holding a gun and speed loaders.
Figure 20:
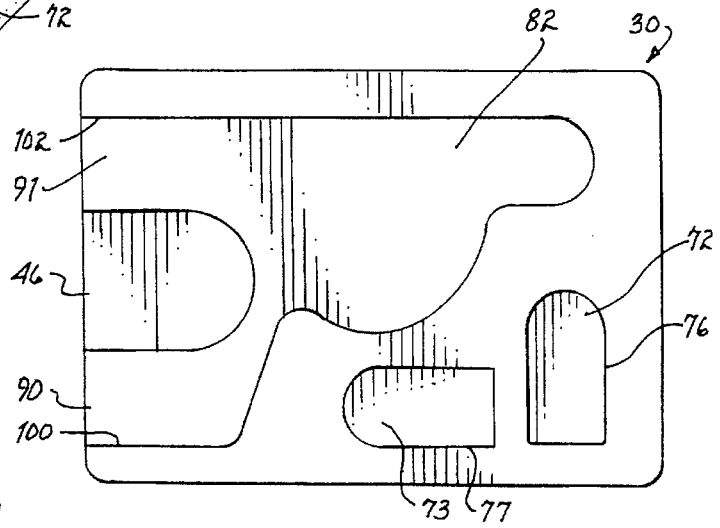
FIG. 20 is a top view of the holder block in FIG. 19.

FIGS. 19 and 20 depict the holder block 30 with different embodiments of the gun cavity 82 and grip access 90. This holder block 30, too, is intended to secure a revolver (not shown). The major modification here is the widened grip access 90, similar to the one (110) in FIGS. 21 and 22. As discussed earlier, in case of an emergency, this modified grip access 90 would allow the revolver to be slipped out quickly from the modified gun cavity 82. To obtain the widened grip access 90, the gun cavity 41 and grip access 70 of FIGS. 7–12 are modified by removing sections 92 and 98 adjacent to the sides 94 and 96 of the grip access 70. The bottom surface 91 of the widened grip access 90 is substantially coplanar with the bottom surface 83 of the gun cavity 82, and the spacing between the sides 102 and 100 of the widened grip access 90 is such as to allow the revolver to be slipped out through the widened grip access 90.

Figure 3:
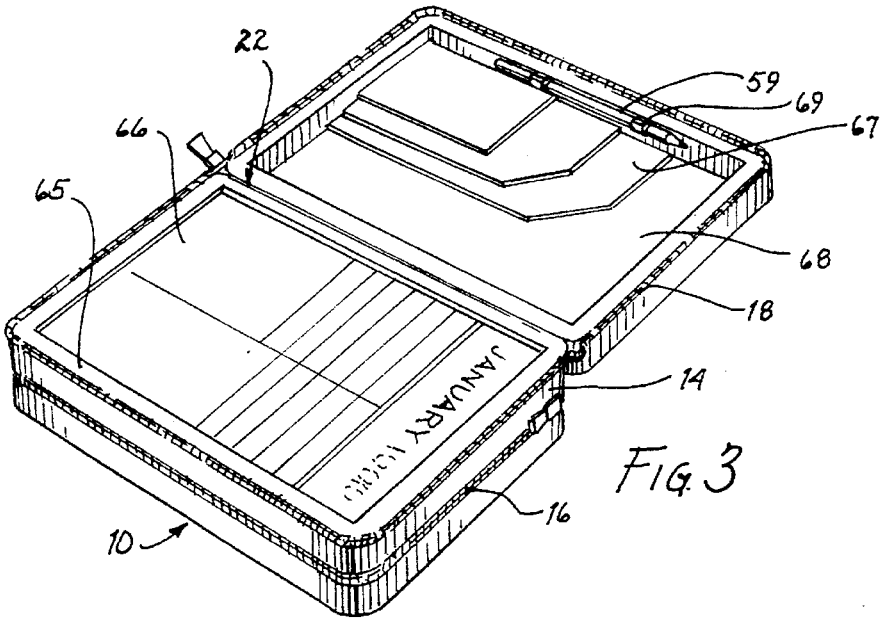
FIG. 3 is a perspective view of the apparatus opened to expose the organizer chamber.

Referring to FIGS. 3 and 4, the organizer chamber 22 is accessed through zipper 18. A support 65 is provided on the surface 64 of the divider 14 for holding a pad of paper 66, such as a daily planner. On the inner surface 68 of the side 13 of the gun case 10 are provided pockets 67. The pockets 67 could hold business cards, credit cards, stationery, or the like. Also, note that the organizer chamber 22 may include a writing utensil holder 69 such as shown in FIG. 3 for holding a pen 59 or other writing utensil.

Figure 6:
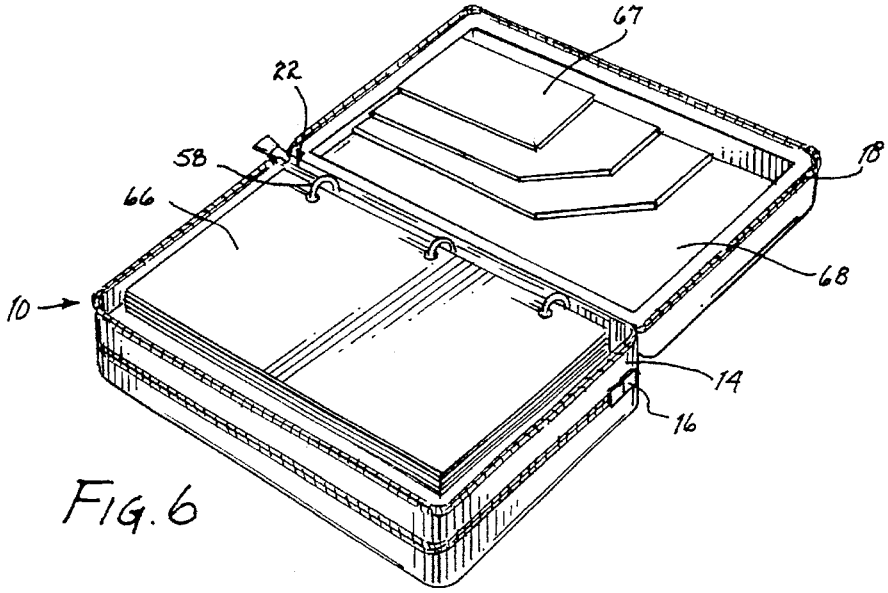
Figure 7:
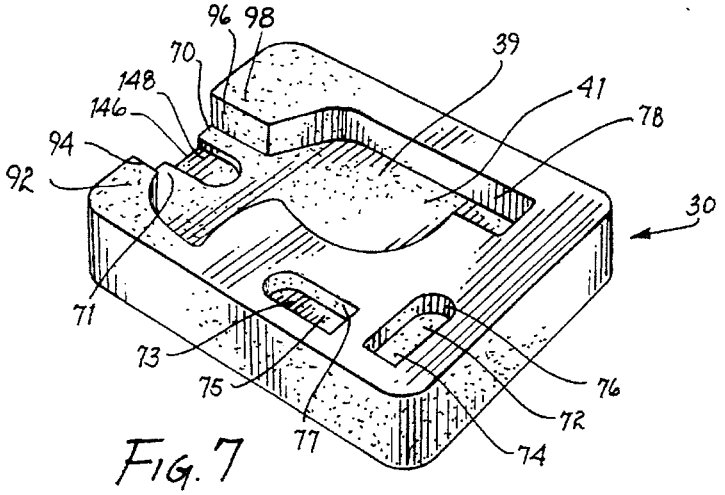
FIG. 7 is a perspective view of one embodiment of the holder block for securing a revolver and speed-loaders.
Figure 8:
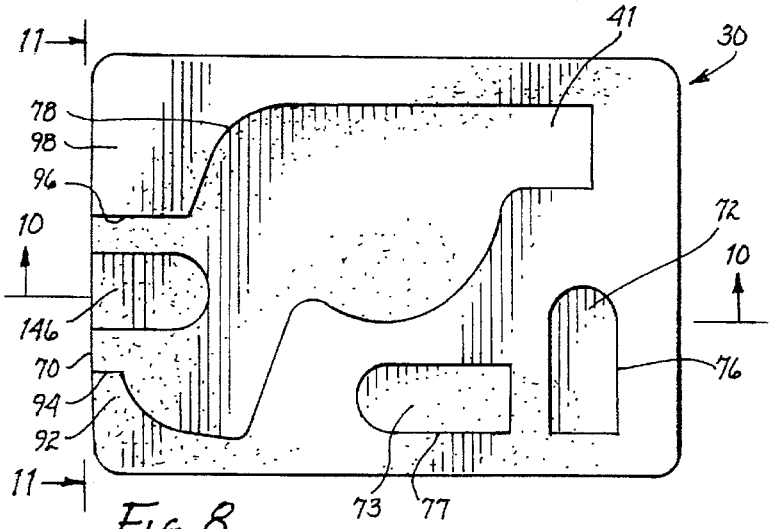
FIG. 8 is a top view of the holder block in FIG. 7.
Figure 9:
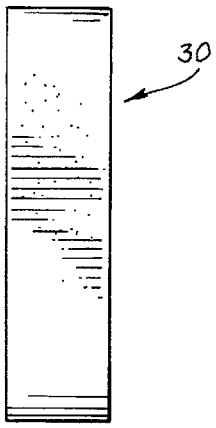
FIG. 9 is an end view of the holder block in FIG. 8.
Figure 10:
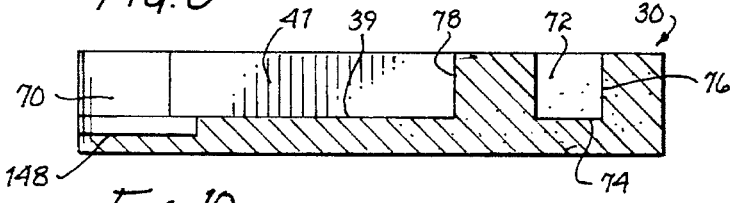
FIG. 10 is a cross-sectional view of the holder block taken through line 10—10 of FIG. 8.
Figure 11:
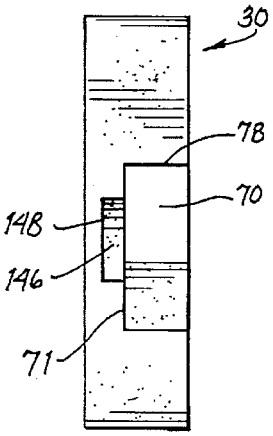
FIG. 11 is an end view of the holder block along line 11—11 of FIG. 8.
Figure 12:
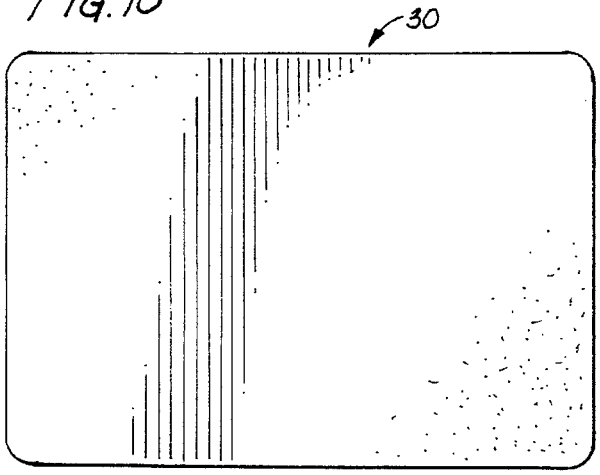
FIG. 12 is a bottom view of the holder block in FIG. 8.
Figure 13:
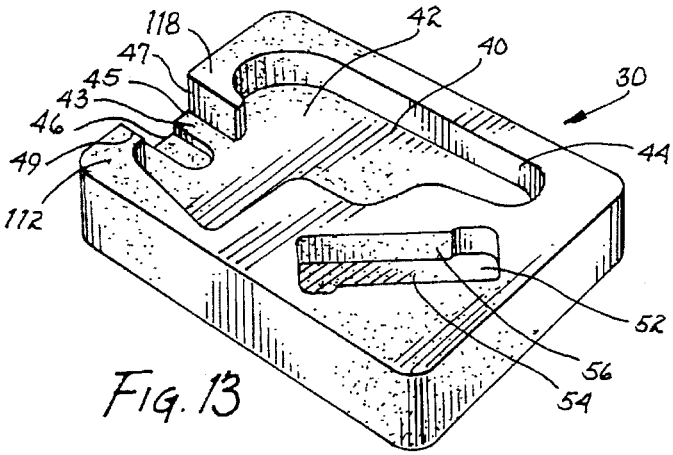
FIG. 13 is a perspective view of another embodiment of the holder block for securing a semi-automatic gun and magazine.
Figure 14:
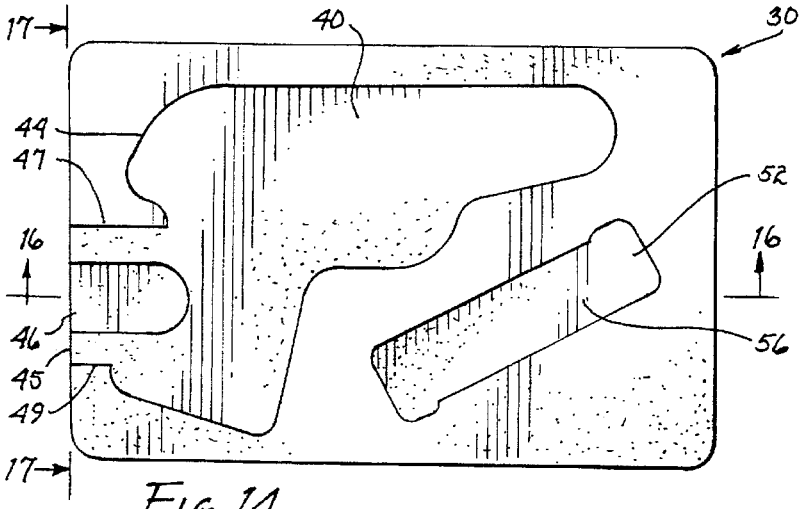
FIG. 14 is a top view of the holder block in FIG. 13.
Figure 15:
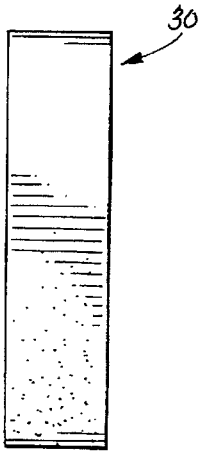
FIG. 15 is an end view of the holder block in FIG. 14.
Figure 16:
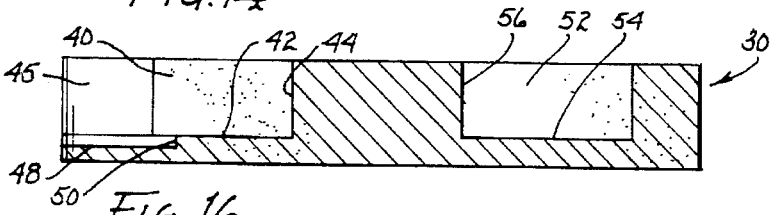
FIG. 16 is a cross-sectional view of the holder block taken through line 16—16 of FIG. 14.
Figure 18:
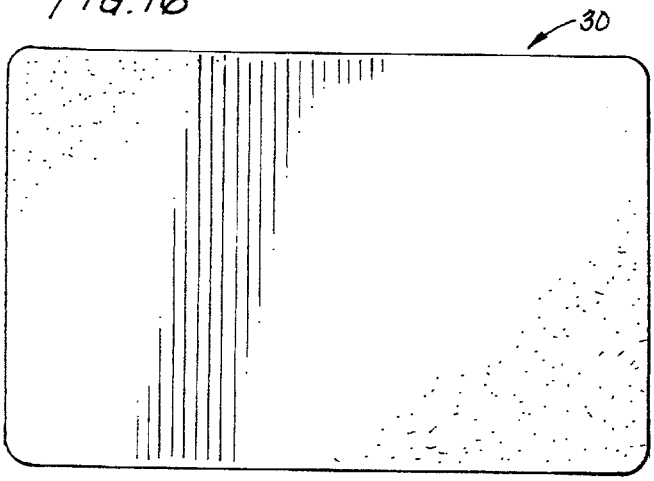
FIG. 18 is a bottom view of the holder block in FIG. 14.
Figure 17:
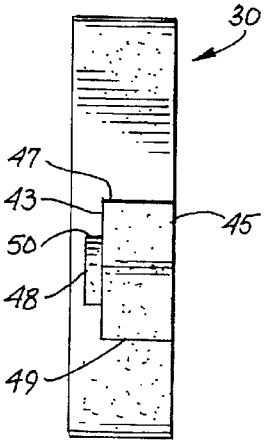
FIG. 17 is an end view of the holder block along line 17—17 of FIG. 14.

Referring to FIG. 6, another embodiment of the gun case 10 is shown which is largely similar to the embodiment of the gun case 10 shown in FIG. 3; however, the embodiment of FIG. 6 includes a three-ring binder for holding papers, in lieu of the support 65 in FIG. 3. The three-ring binder of the gun case 10 in FIG. 6 provides a member which is coupled, in a manner well known in the art, to an inner seam of the organizer chamber 22, or adjacent to this seam. Three clamping rings 58 are coupled to this member in a manner well known in the art. Moreover, the clamping rings 58 may be opened by pulling them apart and/or operating opening levers (not shown) which are normally found on the three-ring binder member. The clamping rings 58 are opened in order to insert papers having corresponding holes, and shut in order to lock the papers in place. These papers may include a pad of paper, a daily planner, or any papers having holes corresponding to the three rings 58. Note, if desired, a writing utensil holder 69 such as is shown if FIG. 3 may be incorporated in this, or other, embodiments.

Figure 23:
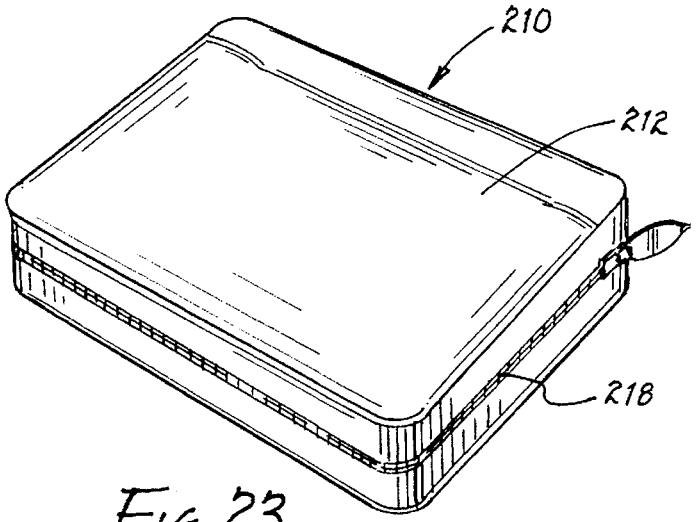
FIG. 23 is a perspective view of another embodiment of a gun case having only one chamber.
Figure 24:
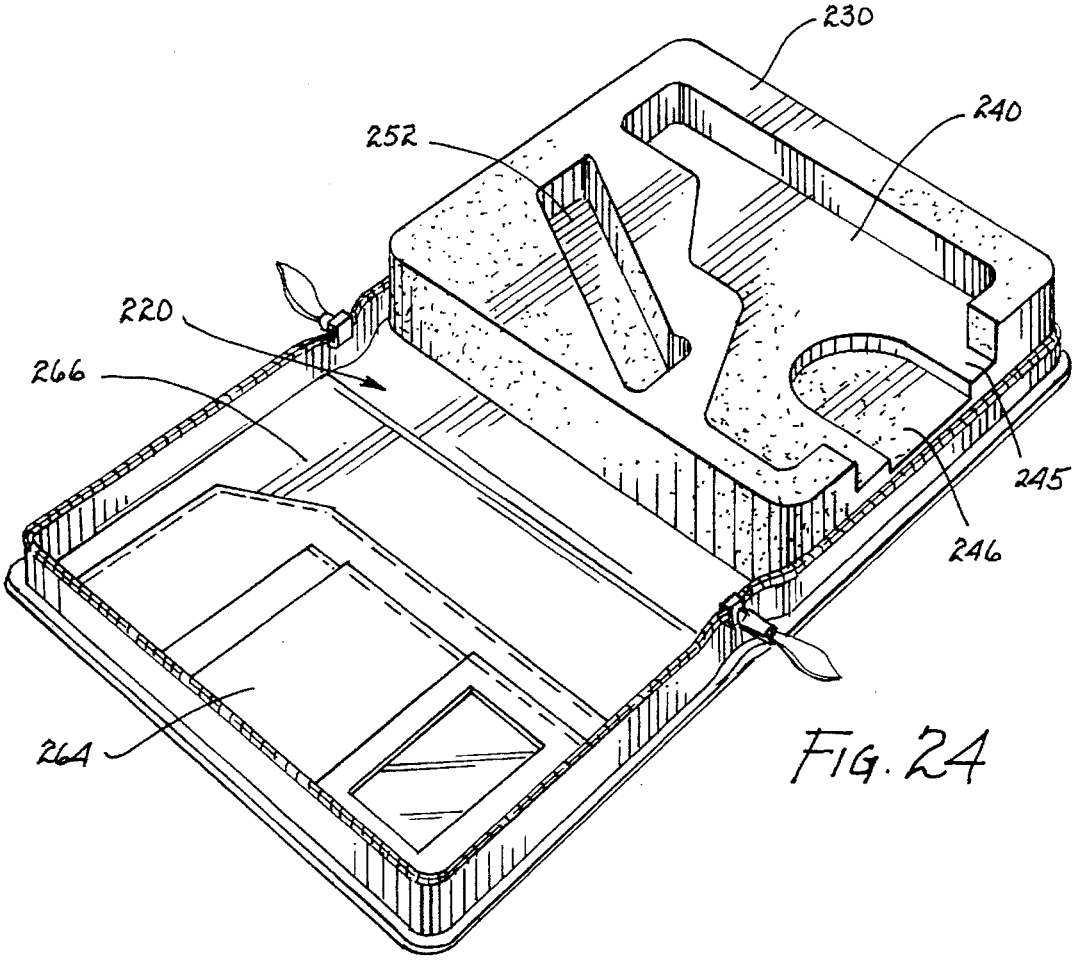
FIG. 24 is a perspective view of the gun case in FIG. 23 opened to the reveal the interior.

FIGS. 23 and 24 depict a simpler form (210) of the gun case 10 discussed hitherto. The major modification here, as compared to the gun case 10 in FIG. 1, is that the gun case 210 in FIGS. 23 and 24 has only one compartment—the gun chamber 220. The gun case 210 is obtained essentially by eliminating the divider 14 of the gun case 10—beyond that, the two gun cases are substantially similar. Also, note that in all other embodiments of the gun case 10, the gun cavity is situated for right,handed shooters; however, the gun cavity 240 in FIG. 24 is situated for left-handed shooters.

The holder block 230 is similar in structure and purpose to the holder block 30 in FIGS. 1–22. In fact, any of the previously discussed embodiments of the holder block 30 may be used with the gun case 210. Thus, the gun cavity 240 of the holder block 230 may be designed for different weapons, and the ammunition space 252 may be designed for various standard accessories to be used with the weapon (not shown) in gun cavity 240. Further, instead of the grip access 245, a widened grip access (not shown) may be incorporated. The quick access 246 is similar in structure and purpose to the one (46) discussed previously.

Also, the holder block 230 is removably attached to an inner surface of a side of the covering 212 of the gun case 210. On the opposite inner surface 266 are provided a number of pockets 264, which may be used for storing business cards, stationery, or the like. Also note, a writing utensil holder could be incorporated here too, if desired. The zipper 218 controls access to the gun chamber 220.

Operation

With reference to FIGS. 1–5 and 13–18, the general operation of the gun case follows hereinafter. Note, that the general operations for other embodiments of the gun case are similar.

The gun case 10 is about the size of an average organizer and hence may easily be carried in the user's hand, a brief case, or a handbag without arousing suspicion. Indeed, the gun case 10 may be used regularly as a daily planner. The zipper 18 can be opened revealing the organizer chamber 22 alone. The pad of paper 66 could be a personal planner, a diary, or just a writing pad. The pockets 67 could hold leaflets, business cards, or the like. The writing utensil holder 69 in FIG. 3 removably stores a pen 59, pencil, or other writing device.

The gun cavity 40 is shaped to contour the particular weapon it is intended to contain. Since the holder block 30 is removably coupled to the gun case 10, a user need not buy a different gun case 10 for different weapons—the user would ideally have one gun case 10, but numerous holder blocks 30 with gun cavities 40 designed for various weapons and ammunition spaces 52 for accessories. Then, depending on the type of weapon the user desires to carry in the gun case 10, the holder block 30 with the gun cavity 40 designed for that weapon is coupled to the wall 32 of the gun chamber 20.

When the weapon needs to be extracted from the gun case 10, the user would access the gun chamber 20 by releasing the zipper 16 enclosing the gun chamber 20. Without the grip access 45, removing the weapon from the gun cavity 40 would not be easy because the gun cavity 40 is designed to fit snugly around the weapon. The grip access 45 enables the user to reach the sides of the handle and vertically lift the weapon out of the gun cavity 40. The widened gun access 110 (see FIG. 21) also allows fast removal of the weapon, because it may be slipped out horizontally, or substantially so, through the widened gun access 110. Yet another feature enabling the easy removal of the weapon from the gun cavity 40 is the quick access 46 feature. Since the quick access 46 extends below the handle of the weapon, users will be able to wrap their fingers around the handle and grip the weapon handle firmly. Finally, spare ammunition may be stored in the ammunition space 52 designed to contain the ammunition for the particular weapon in the gun cavity 40.

The operation of the gun case 210 is similar to that explained for the gun case 10, except that the gun case 210 has only the gun chamber 220.

While the invention has been particularly shown and described with reference to the preferred embodiments thereof, it will be understood by those skilled in the art that the foregoing and other changes in form and details may be made therein without departing from the spirit and scope of the invention. Note that the preferred embodiments of the gun cases carry semi-automatic weapons and revolvers; however, other weapons may be implemented if desired. For example, in any of the embodiments of the gun case 10, VELCRO or other types of fasteners could be used to replace the zippers 16, 18, and 218 as fastening devices.

What is claimed is:

1. An apparatus for concealing and carrying a weapon comprising, in combination:

support means for supporting the weapon covering means for enclosing said support means and concealing the weapon; and fastening means coupled to said covering means for closing said covering means to conceal the weapon and for opening said covering means to remove the weapon from said support means; said support means comprises:

a holder block having a first recess in a first side of said holder block for securing the weapon; and connection means coupled to a surface of said holder bock located opposite said first side of said holder block for removably coupling said support means to said covering means.

2. The apparatus of claim 1 wherein said covering means has an exterior configuration having a substantially parallelepiped shape when closed and having an interior cavity.

3. The apparatus of claim 2 wherein a first interior surface of said covering means has a plurality of pockets.

4. The apparatus of claim 3 further including means for retaining a writing utensil coupled to said first interior surface of said covering means.

5. The apparatus of claim 3 further including a second connection means, coupled to a second interior surface of said covering means located opposite said first interior surface when said covering means is closed, for removably attaching said support means to said covering means.

6. An apparatus for concealing and carrying a weapon comprising, in combination:

support means for supporting the weapon;

covering means for enclosing said support means and concealing the weapon; and fastening means coupled to said covering means for closing said covering means to conceal the weapon and for opening said covering means to remove the weapon from said support means; said covering means has an exterior configuration having a substantially parallelepiped shape when closed and having an interior cavity; a first interior surface of said covering means has a plurality of pockets; further including a second interior surface of said covering means and first connection means, coupled to said second interior surface of said covering means located opposite said first interior surface when said covering means is closed, for removably attaching said support means to said covering means; said support means comprises:

a holder block having a first recess in a first side of said holder block for securing the weapon; and second connection means coupled to a surface of said holder block located opposite said first side of said holder block for removably coupling said support means to said covering means with said first and second connection means.

7. The apparatus of claim 6 wherein said holder block forms said first recess by providing a bottom planar surface for supporting a bottom side of the weapon, and a perimeter wall surface extending upward from said bottom planar surface and around a portion of a perimeter area of said weapon when said bottom side of the weapon lies on said bottom planar surface.

8. The apparatus of claim 7 therein said perimeter wall surface extends around all of said perimeter area of said weapon except for an area adjacent to a grip of the weapon.

9. The apparatus of claim 8 further including quick access means located beneath said bottom planar surface and comprising a depression in said bottom planar surface for permitting a user's fingers to reach beneath said bottom planer surface for quickly removing the weapon.

10. The apparatus of claim 6 including a further recess in said first side of said holder block for retaining a magazine for use with the weapon, and including a still further recess in said first side of said holder block for retaining a speed loader for use with the weapon.

11. An apparatus for carrying and concealing a weapon comprising, in combination:

support means for supporting the weapon;

covering means for enclosing said support means and concealing the weapon; said covering means having an inner lengthwise seam, and divider means coupled to said inner lengthwise seam of said covering means for dividing an interior cavity of said covering means into a first and second sub-cavity; said support means comprises:

a holder block having a first recess in a first side of said holder block for securing the weapon, said first recess providing a bottom planar surface for supporting a bottom side of the weapon, and a perimeter wall surface extending upward from said bottom planar surface and around a portion of a perimeter area of the weapon when said bottom side of the weapon lies on said bottom planar surface; and connection means coupled to a surface of said holder block located opposite said first side of said holder block for removably coupling said support means to said covering means.

12. The apparatus of claim 10 further including first fastening means coupled to said divider means and to said covering means for selectively opening and closing a portion of said covering means for selectively accessing said first sub-cavity containing the weapon and second fastening means coupled to said divider means and to said covering means for selectively opening and closing another portion of said covering means for selectively accessing said second sub-cavity.

13. The apparatus of claim 12 wherein a first side of said divider means has a first plurality of pockets, and wherein a first interior surface of said covering means has a second plurality of pockets.

14. The apparatus of claim 13 wherein said first sub-cavity is enclosed by said portion of said covering means, said first side of said divider means; and said first fastening means, and wherein said second sub-cavity is enclosed by said another portion of said covering means, a second side of said divider means, and said second fastening means.

15. The apparatus of claim 13 further including means for retaining a writing utensil coupled to said first interior surface of said covering means.

16. The apparatus of claim 14 further including insert means coupled on a back side thereof with an inner portion of said covering means for retaining at least one of a pad of paper and a daily planner.

17. The apparatus of claim 16 wherein said insert means comprises a three-ring binder.

18. The apparatus of claim 16 further including a second connection means, coupled to a second interior surface of said covering means located opposite said first interior surface of said covering means when said covering means is closed, for removably attaching said support means to said covering means.

19. An apparatus for carrying and concealing a weapon comprising, in combination:

support means for supporting the weapon;

covering means for enclosing said support means and concealing the weapon; said covering means having an inner lengthwise seam, and divider means coupled to said inner lengthwise seam of said covering means for dividing an interior cavity of said covering means into a first and second sub-cavity; further including first fastening means coupled to said divider means and to said covering means for selectively opening and closing a portion of said covering means for selectively accessing said first sub-cavity containing the weapon and second fastening means coupled to said divider means and to said covering means for selectively opening and closing another portion of said covering means for selectively accessing said second sub-cavity; a first side of said divider means has a first plurality of pockets, and wherein a first interior surface of said covering means has a second plurality of pockets; said first sub-cavity is enclosed by said portion of said covering means, said first side of said divider means, and said first fastening means, and wherein said second sub-cavity is enclosed by said another portion of said covering means, a second side of said divider means, and said second fastening means; further including insert means coupled on a back side of said covering means with an inner portion of said covering means for retaining at least one of a pad of paper and a daily planner; further including a second interior surface of said covering means and first connection means, coupled to said second interior surface of said covering means located opposite said first interior surface of said covering means when said covering means is closed, for removably attaching said support means to said covering means; said support means comprises:

a holder block having a first recess in a first side of said holder block for securing the weapon, said first recess providing a bottom planar surface for supporting a bottom side of the weapon, and a perimeter wall surface extending upward from said bottom planar surface and around a portion of a perimeter area of the weapon when said bottom side of the weapon lies on said bottom planar surface; and second connection means coupled to a surface of said holder block located opposite said first side of said holder block for removably coupling said support means to said covering means with said first and second connection means.

20. The apparatus of claim 19 wherein said perimeter wall surface extends around all of said perimeter area of the weapon except for an area adjacent to a grip of the weapon.

21. The apparatus of claim 20 further including quick access means located beneath said bottom planar surface and comprising a depression in said bottom planar surface for permitting a user's fingers to reach beneath the bottom planar surface for quickly removing the weapon.

22. The apparatus of claim 21 including a further recess in said first side of said holder block for retaining a magazine for use with the weapon, and including a still further recess in said first side of said holder block for retaining a speed loader for use with the weapon.

23. A method for concealing and carrying a weapon comprising the steps of:

providing support means for supporting the weapon;

providing covering means for enclosing said support means and concealing the weapon; and providing fastening means coupled to said covering means for closing said convening means to conceal the weapon and for opening said covering means to remove the weapon from said support means;

said step of providing said support means comprising the steps of:

providing a holder block having a recess in a first side of said holder block for securing the weapon;

providing connection means coupled to a surface of said holder block located opposite said first side of said holder block for removably coupling said support means to said covering means;

said step of providing said recess in said holder block comprising the steps of providing a bottom planar surface for supporting a bottom side of the weapon and a perimeter wall surface extending upward from said bottom planar surface and around a portion of a perimeter area of said weapon when the bottom side of the weapon lies on said bottom planar surface; and providing quick access means located beneath said bottom planar surface and comprising a depression in said bottom planar surface for permitting a user's fingers to reach beneath said bottom planar surface for quickly removing the weapon.

* * * * *